US007340934B2

(12) United States Patent
Kurokawa et al.

(10) Patent No.: US 7,340,934 B2
(45) Date of Patent: Mar. 11, 2008

(54) PRESS MOLDING DIE AND MANUFACTURING METHOD OF SAME

(75) Inventors: Takanori Kurokawa, Okazaki (JP); Kazuo Fukaya, Toyota (JP); Takahiro Ichikawa, Nagoya (JP); Takashige Yoneda, Nagoya (JP); Taketoshi Minami, Nagoya (JP)

(73) Assignees: Toyota Jidosha Kabushiki Kaisha, Toyota-shi, Aichi-ken (JP); Teikoku Kuromu Co., Ltd., Nagoya, Aichi (JP)

( * ) Notice: Subject to any disclaimer, the term of this patent is extended or adjusted under 35 U.S.C. 154(b) by 122 days.

(21) Appl. No.: 10/802,815

(22) Filed: Mar. 18, 2004

(65) Prior Publication Data

US 2004/0194527 A1 Oct. 7, 2004

(30) Foreign Application Priority Data

Apr. 1, 2003 (JP) ..... 2003-097962

(51) Int. Cl.
*B21D 37/00* (2006.01)
*B21D 28/34* (2006.01)

(52) U.S. Cl. ..... 72/350; 72/351; 428/403; 76/107.1

(58) Field of Classification Search ..... 204/157.74; 72/347, 350, 351, 462; 428/403; 76/107.1
See application file for complete search history.

(56) References Cited

U.S. PATENT DOCUMENTS 4,038,359 A * 7/1977 Pendleton ..... 264/263
4,038,859 A * 8/1977 Pavleszek ..... 72/347
4,745,792 A * 5/1988 Story et al. ..... 72/351
5,979,211 A * 11/1999 Pahl et al. ..... 72/351
6,136,456 A * 10/2000 Komatsubara et al. ..... 428/667
6,354,131 B1 * 3/2002 Pirchl ..... 72/351
6,807,838 B2 * 10/2004 Iwaya ..... 72/350
2002/0068108 A1 6/2002 Iwaya (Continued)

FOREIGN PATENT DOCUMENTS

CN 1060881 A 5/1992

(Continued)

OTHER PUBLICATIONS

Japanese Office Action dated Mar. 28, 2007.

*Primary Examiner*—David B Jones
(74) *Attorney, Agent, or Firm*—Finnegan, Henderson, Farabow, Garrett & Dunner, L.L.P.

(57) ABSTRACT

A press molding die capable of preventing a workpiece from moving is provided. The press molding die includes a punch for pressing a workpiece; a molding die having a molding surface on which the workpiece is placed and a concave portion which is formed on the molding surface and which has a shape corresponding to the punch; a pad for pressing a part of the workpiece placed on the molding surface and which is on the periphery of the concave portion; and a micro-rough layer which is formed by performing a particulate coating process on at least one of a portion of the pad, for pressing the workpiece, and a portion of the molding surface, corresponding to the portion of the pad. Preferably, the height of roughness of the micro-rough layer is 0.01 to 0.06 mm, and the particulate coating process is performed using a silicofluoric chrome plating solution.

4 Claims, 6 Drawing Sheets

U.S. PATENT DOCUMENTS

2006/0208151 A1* 9/2006 Dumm et al. ..... 249/114.1

FOREIGN PATENT DOCUMENTS

DE 199 38 452 * 2/2001
DE 199 38 452 A1 2/2001
JP 54-71048 11/1977
JP 58-123896 7/1983
JP 03-268808 11/1991
JP 11-151531 6/1999
JP 2002-302792 10/2002
WO WO 03/013756 A1 2/2003

* cited by examiner

PRESS MOLDING DIE AND MANUFACTURING METHOD OF SAME

INCORPORATION BY REFERENCE

The disclosure of Japanese Patent Application No. 2003-097962 filed on Apr. 1, 2003, including the specification, drawings and abstract is incorporated herein by reference in its entirety.

BACKGROUND OF THE INVENTION

1. Field of the Invention

The invention relates to a press molding die capable of preventing a workpiece from moving during press molding, and a manufacturing method of same.

2. Description of the Related Art

In order to press a workpiece into shapes, initially, the workpiece is placed on a molding surface of a molding die having a predetermined-shaped concave portion. On the periphery of the concave portion, the workpiece is pressed to the molding die by a pad and is fixed. Then, the workpiece is plastically deformed by being pressed by a punch having a shape corresponding to the concave portion. In such press molding, a problem occurs that the workpiece moves into the concave portion, that is, so-called displacement of the workpiece is caused. The displacement of the workpiece affects the accuracy of a press molded product, the quality of a surface of the press molded product, and the like. In addition, due to such a problem useful lives of the molding die and the punch are shortened, and the cost of maintenance of the molding die and the punch increases.

An example of methods for preventing the workpiece from moving is to increase the pressing force of the pad during press molding. However, since the pressing force of the pad acts in the direction perpendicular to the direction in which the workpiece moves, it is necessary to apply a tremendous amount of pressing force in order to prevent the workpiece from moving. Also, it is impossible to prevent the workpiece from moving substantially completely. It is also possible to prevent the workpiece from moving by precisely controlling the distance between the molding die and the pad. However, such control requires a complicated configuration of the die and skills in adjustment, thereby increasing the cost of manufacturing the die.

As related art, Japanese Patent Laid-Open Publication No. 3-268808 discloses a known metalworking tool for suppressing occurrence of a weld marks which are likely to occur during cold work and press work of metal, and for preventing a slip which occurs due to lubricating oil used for preventing occurrence of the weld marks. The metalworking tool is a plastic forming tool and a plurality of small dents is formed on the smooth surface of the metalworking tool. Each of the dents has a diameter of 5 to 50 μm, and a depth of 0.5 to 5 μm. The total area of the dents accounts for 5 to 50% of the surface area of the tool before the dents are formed.

SUMMARY OF THE INVENTION

According to an aspect of the invention, a press molding die is provided. The press molding die includes a punch which presses a workpiece; a molding die having a molding surface on which the workpiece is placed and a concave portion which is formed on the molding surface and which has a shape corresponding to the punch; a pad which presses a portion that is a part of the workpiece placed on the molding surface and that is on the periphery of the concave portion; and a layer having micro-roughness (hereinafter, referred to as a "micro-rough layer") which is formed by performing a particulate coating process on at least one of a portion of the pad, for pressing the workpiece, and a portion of the molding surface, corresponding to the portion of the pad, for pressing the workpiece.

According to another aspect of the invention, a method for manufacturing a press molding die is provided. The manufacturing method includes a step for forming a punch which presses a workpiece; a step for forming a molding die having a molding surface on which the workpiece is placed and a concave portion which is formed on the molding surface and which has a shape corresponding to the punch; a step for forming a pad which presses a portion that is a part of the workpiece placed on the molding surface and that is on the periphery of the concave portion; and a step for forming a micro-rough layer by performing a particulate coating process on at least one of a portion of the pad, for pressing the workpiece, and a portion of the molding surface, corresponding to the portion of the pad for pressing the workpiece.

According to the press molding die and the manufacturing method of same, by forming the micro-rough layer on at least one of the portion of the pad and the portion of the molding die, which are on the periphery of the concave portion, the roughness of the micro-rough layer deforms the workpiece such that the deformation prevents the workpiece from moving. As a result, it is possible to prevent the workpiece from moving into the concave portion.

BRIEF DESCRIPTION OF THE DRAWINGS

The above-mentioned embodiment and other embodiments, objects, features, advantages, technical and industrial significance of this invention will be better understood by reading the following detailed description of the exemplary embodiments of the invention, when considered in connection with the accompanying drawings in which.

DETAILED DESCRIPTION OF THE EXEMPLARY EMBODIMENTS

In the following description, the present invention will be described in more detail in terms of exemplary embodiments.

Figure 1:
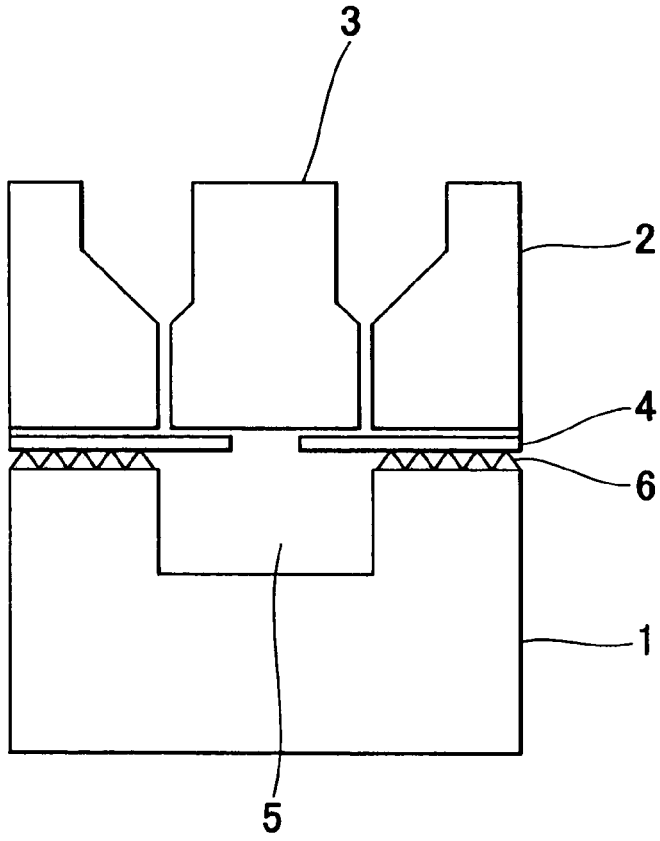
FIG. 1 a cross sectional view of a press molding die according to the invention, during press molding.

FIG. 1 is a view schematically showing a press molding die according to the invention. The press molding die includes a molding die 1, a pad 2, and a punch 3, and is used for pressing a workpiece 4 into shapes. In the press molding die, a concave portion 5 having a shape corresponding to the punch 3 is formed on a molding surface of the molding die 1. The workpiece 4 placed on the molding surface is pressed to the molding die 1 by the pad 2 and is fixed, on the periphery of the concave portion 5. In this case, the press molding die according to the invention is characterized in that a micro-rough layer 6 is formed by performing a particulate coating process on at least one of a portion of the pad 2, for pressing the workpiece 4, and a portion of the molding surface, corresponding to the portion of the pad 2, for pressing the workpiece 4.

In the press molding die, when the workpiece 4 is sandwiched between the molding die 1 and the pad 2 and is pressed by the pad 2, the roughness of the micro-rough layer 6 deforms the workpiece 4 using the pressing force of the pad 2. The deformation acts as resistance in the direction perpendicular to the direction in which the workpiece 4 moves. In the press molding die according to the invention, the workpiece 4 contacts the molding die 1 only at the convex portions of the micro-rough layer 6. Therefore, in the case where the micro-rough layer 6 is formed, the pressing force applied to the workpiece 4 per unit area is larger than that in the case where the micro-rough layer 6 is not formed, even the pressing force applied by the pad 2 is the same. As a result, it is possible to effectively prevent the workpiece 4 from moving.

It is preferable to set the height of the roughness of the micro-rough layer 6 to 0.01 to 0.06 mm. If the height of the roughness of the micro-rough layer 6 is smaller than 0.01 mm, the effect of preventing the workpiece 4 from moving using the micro-rough layer 6 cannot be obtained effectively. On the other hand, if the height of the roughness of the micro-rough layer 6 exceeds 0.06 mm, there occurs transfer marks which are sufficiently large to be visually observed even coating is applied to the molding surface after the workpiece is molded, which degrades the appearance quality of the molded product.

The micro-rough layer 6 is formed by performing the particulate coating process. In the particulate coating process, the size of a particle of the metal having high hardness is increased on the plating surface. The plating process needs to be performed at an appropriate temperature of the plating solution, an appropriate current density and the like. Also, the plating process is preferably performed using a silicofluoric chrome plating solution.

The silicofluoric chrome plating solution preferably contains 200 to 300 g of chromic anhydride, 1 to 8 g of sodium silicofluoride, and 0.5 to 1.5 g of sulfuric acid per liter. The particulate coating process is preferably performed using the plating solution, in the condition in which the temperature of the plating solution is 40 to 50° C., the current density is 100 to 150 A/dm$^2$, and the plating time is 3 to 10 minutes. The thus obtained micro-rough layer 6 has physical properties such as a thickness of 10 to 40 μm, a hardness of 1000 to 1100 HV, a particle diameter of 10 to 30 μm, and surface roughness of 10 to 30 μmRy. Also, the adhesion of the micro-rough layer 6 to the press molding die is high. Accordingly, it is possible to sufficiently satisfy the requirements on the micro-rough layer 6 which is formed on the press molding die.

The particulate coating process for forming the micro-rough layer 6 can be performed in the same process as a common plating process. Initially, a surface of the press molding die, on which the particulate coating process is performed, is degreased, and another surface, on which the particulate coating process is not performed, is masked. Then, the press molding die is set on a jig, and an anode and a cathode are set. Then, the press molding die is immersed, for example, in the silicofluoric chrome plating solution having the above-mentioned composition. Electric power is supplied for a predetermined period, the press molding die is taken out from the silicofluoric chrome plating solution, is washed, the jig is removed, and the press molding die is dried. Thus, the micro-rough layer 6 is formed by the particulate coating process.

Figure 2:
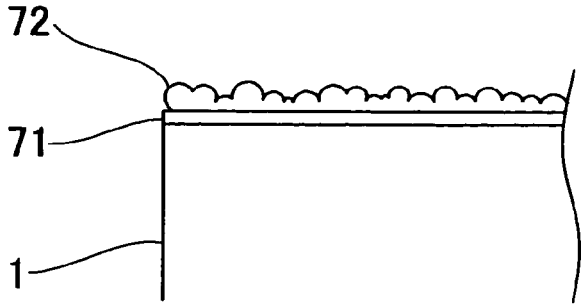
FIG. 2 is a cross sectional view showing an example of a micro-rough layer.

The micro-rough layer 6 may be formed of a plurality of plated layers, as shown in FIG. 2. In the example shown in FIG. 2, the micro-rough layer 6 is formed of a lower side plated layer 71 having a smooth surface, and an upper side plated layer 72 which is formed by the particulate coating process and which has roughness. In the case where the micro-rough layer 6 is formed of two plated layers, durability of the press molding die and the micro-rough layer 6 can be enhanced, compared with the case where the micro-rough layer 6 is formed only by the particulate coating process.

On the molding surface of the press molding die, grooves which are formed by common machining may be formed, in addition to the micro-rough layer 6. A plurality of grooves which are parallel to each other, and another plurality of grooves which are parallel to each other are formed such that the plurality of grooves and the other plurality of grooves extend in different directions. The grooves formed in the direction parallel to the direction in which the workpiece 4 moves have low degree of resistance to the movement of the workpiece 4. Therefore, it is preferable to form the grooves in the direction substantially perpendicular to the direction in which the workpiece 4 moves.

Figure 3A:
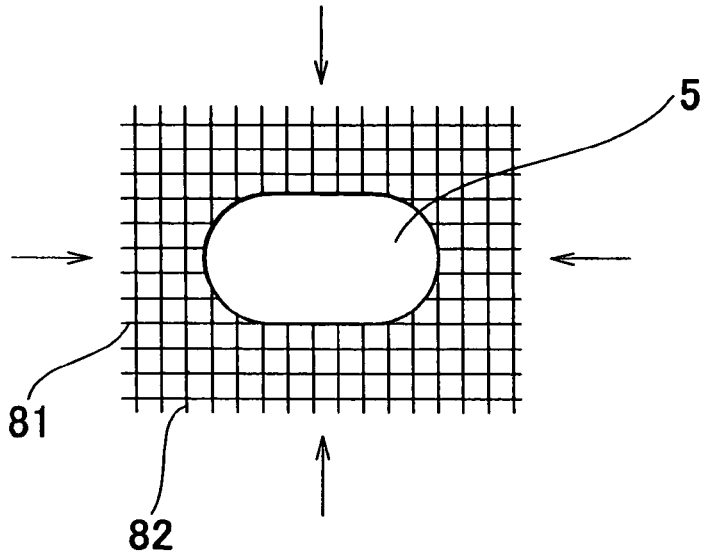
FIG. 3A is a top view showing an example of a concave portion of the molding die and grooves formed on the periphery of the concave portion.
Figure 3B:
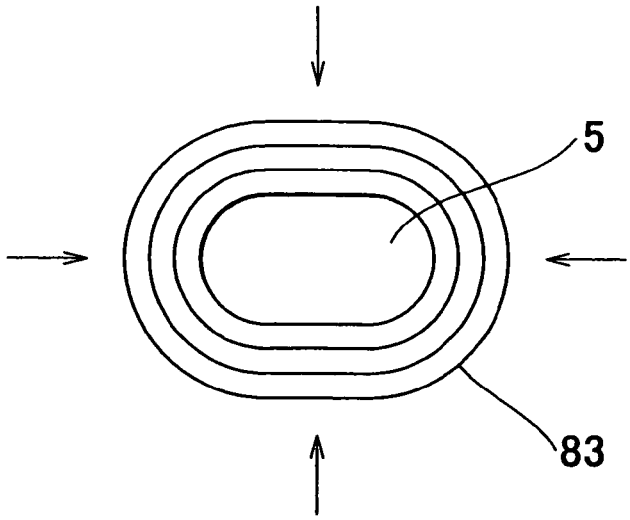
FIG. 3B is a top view showing another example of a concave portion of the molding die and grooves formed on the periphery of the concave portion.

Concrete examples of the grooves are shown in FIG. 3 which is the top view of the molding die 1, at the center of which is the concave portion 5. In the example shown in FIG. 3A, a plurality of vertical grooves 81 and another plurality of horizontal grooves 82 which are perpendicular to each other are formed on the molding surface of the molding die 1. The distance between the grooves is, for example, 2 mm. In the example shown in FIG. 3B, grooves 83 each of which has a shape similar to that of the periphery of the concave portion 5. The grooves 83 are formed in a loop shape so as to surround the concave portion 5. The direction in which the workpiece 4 moves is the direction radiating from the concave portion 5. Therefore, the grooves 83 are formed in the direction perpendicular to all the directions in which the workpiece 4 moves, and the effect of preventing the workpiece 4 from moving is particularly high. The grooves can be formed by shot blasting, ceramic spraying, pattern plating, laser spraying, or the like.

In the press molding using the press molding die according to the invention, initially, the workpiece 4 is placed on the molding die 1 such that the rear surface of the workpiece 4 faces the molding surface of the molding die 1. Then, the workpiece 4 is pressed to the press molding die by the pad 2, and is fixed. The workpiece 4 is then pressed by the punch 3 so as to be plastically deformed. In this case, the workpiece 4 contacts only the convex portions of the micro-rough layer 6 of the press molding die. Therefore, the pressing force applied to the workpiece 4 per unit area is considerably large, compared with the case where the micro-rough layer 6 is not formed. As the punch 3 is moved downward, the force for moving the workpiece 4 into the concave portion 5 is generated. At this time, the roughness of the micro-rough layer deforms the workpiece such that the deformation prevents the workpiece from moving. The micro-rough layer 6 generates transfer marks on the rear surface of the workpiece 4. However, since the micro-rough layer 6 does not affect the front surface of the workpiece 4, the appearance quality of the workpiece 4 is not affected.

Figure 4:
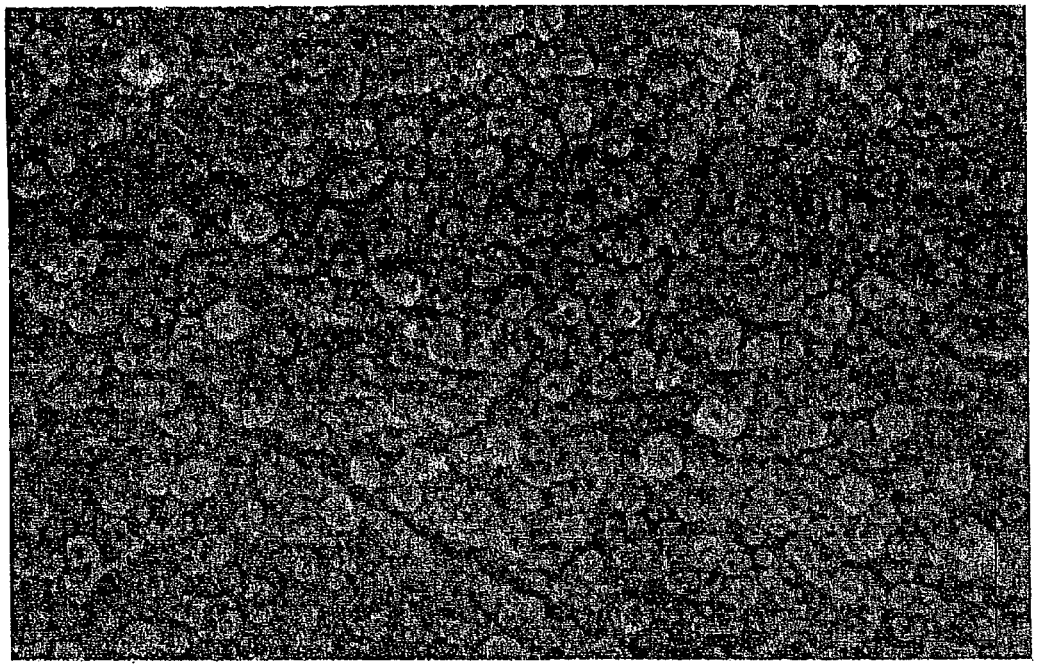
FIG. 4 is a microscope photograph of a micro-rough layer formed in a first embodiment.
Figure 5:
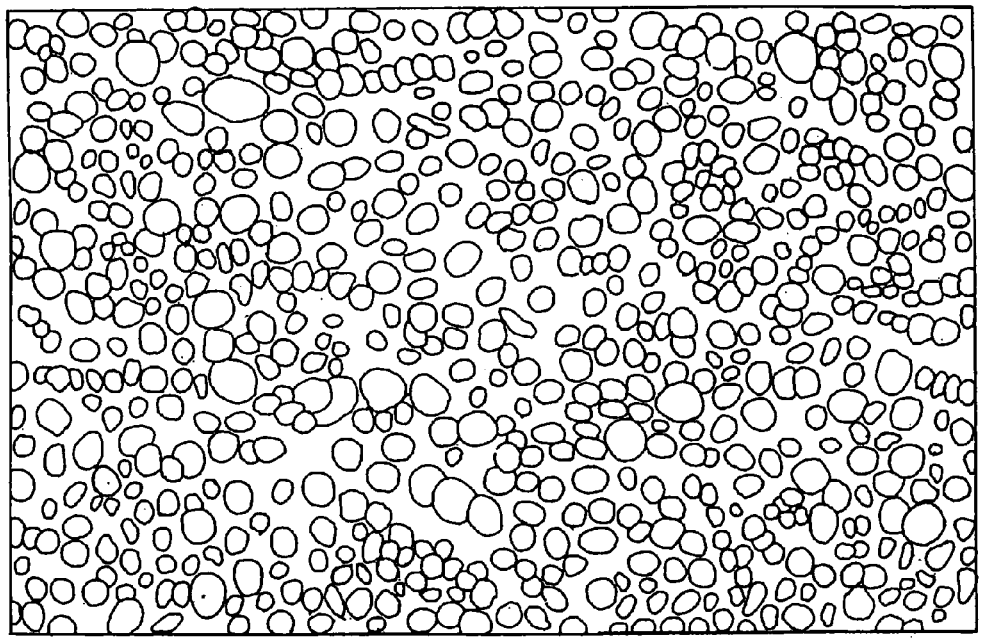
FIG. 5 is a pattern diagram of the microscope photograph shown in FIG. 4.
Figure 6:
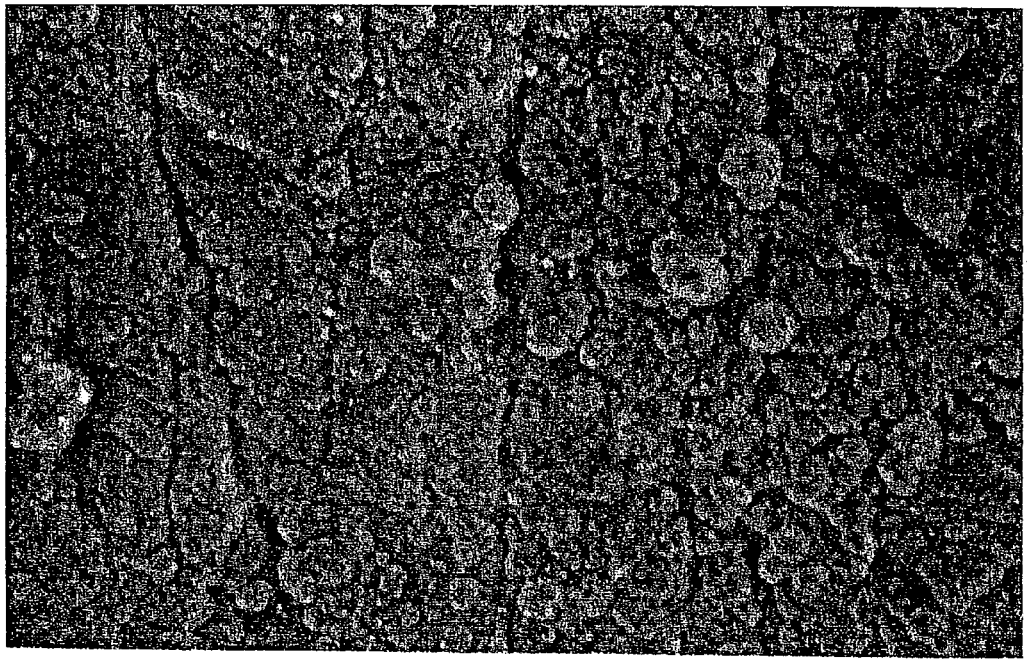
FIG. 6 is a microscope photograph of a micro-rough layer formed in a second embodiment.
Figure 7:
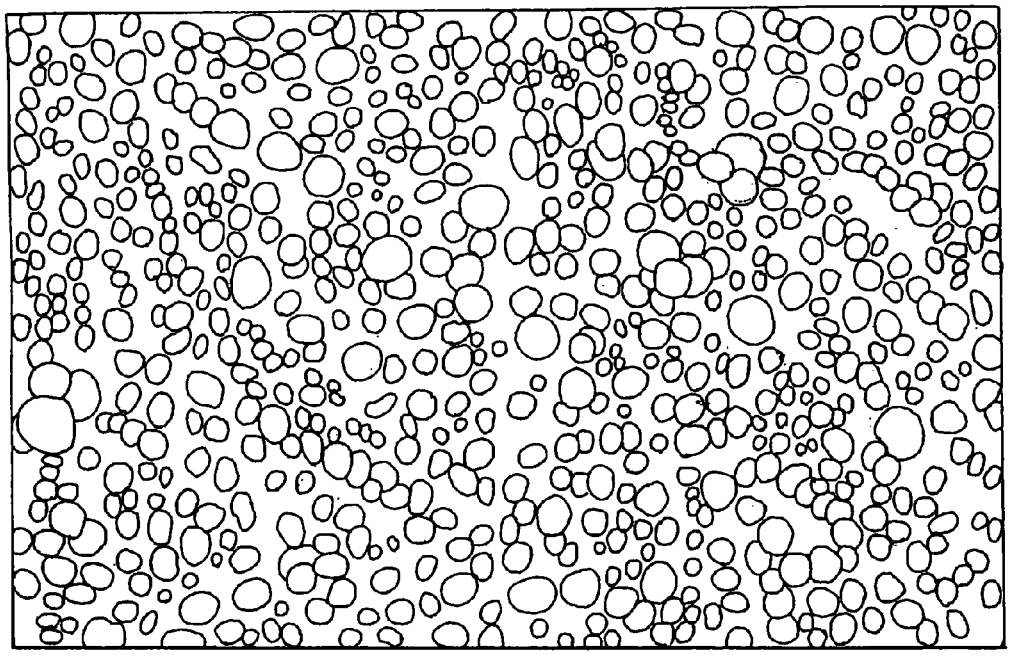
FIG. 7 is a pattern diagram of the microscope photograph shown in FIG. 6.

A micro-rough layer was formed on a surface of a molding die by the particulate coating process using a plating solution and plating conditions shown in the following table. A microscope photograph of the formed micro-rough layer was taken. FIG. 4 shows the microscope photograph of the micro-rough layer formed in the first embodiment. FIG. 5 is a pattern diagram of the microscope photograph shown in FIG. 4. FIG. 6 shows the microscope photograph of the micro-rough layer formed in the second embodiment. FIG. 7 is a pattern diagram of the microscope photograph shown in FIG. 6. The diameter of the particle of the formed micro-rough layer was decided, and the thickness of the plating was measured by an electromagnetic thicknessmeter. Then, press molding was performed using both of the molding dies, and movement of the workpiece during press molding and the surface properties of the workpiece after press molding were evaluated. Table 1 shows the result of the evaluation.

TABLE 1

| | First embodiment | Second embodiment |
|---|---|---|
| Plating solution composition | | |
| Chromic acid concentration | 234.3 g/L | 249.9 g/L |
| Sulfuric acid concentration | 0.9 g/L | 1.0 g/L |
| Sodium silicofluoride concentration | 6.3 g/L | 6.8 g/L |
| Plating conditions | | |
| Solution temperature | 45° C. | 45° C. |
| Current density | 120 A/dm$^2$ | 150 A/dm$^2$ |
| Plating time | 5 min. | 5 min. |
| Micro-rough layer evaluation | | |
| Particle diameter | 20 μm (average) | 25 μm (average) |
| Plating thickness | approximately 25 μm | approximately 30 μm |
| Press molding evaluation | | |
| Workpiece movement | None | None |
| Workpiece surface properties | Good | Good |

According to the invention, a micro-rough layer is formed on a molding surface of a press molding die, at a portion to which a workpiece is pressed by a pad and is fixed. With this arrangement, it is possible to prevent the workpiece from moving into a concave portion, that is, it is possible to prevent so-called displacement of the workpiece, without accurately controlling the conditions of press molding. Since the micro-rough layer is formed by the particulate coating process, it is possible to obtain a press molding die with a simple configuration, and to manufacture the press molding die at low cost.

While the invention has been described with reference to exemplary embodiments thereof, it is to be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other embodiments and configurations, including more, less or only a single element, are also within the spirit and scope of the invention.

What is claimed is:

1. A press molding die, comprising:

a punch which moves in a first direction, pressing a workpiece;

a molding die having a molding surface on which the workpiece is placed and a concave portion which is formed on the molding surface and which has a shape corresponding to the punch, said punch moving into the concave portion to deform the workpiece into a shape corresponding to the concave portion;

a pad which presses a portion that is a part of the workpiece placed on the molding surface and that is on a periphery of the concave portion; and a micro-rough layer provided on at least one of the molding surface or the pad having a particle diameter of 10 to 30 μm, a thickness of 10 to 40 μm, a hardness of 1000 to 1100 HV, a surface roughness of 10 to 30 μmRy, and an average height of roughness of 0.01 to 0.06 mm, and convex portions;

wherein said micro-rough layer is configured so that the workpiece contacts only at the convex portions, causing deformation of the workpiece in a second direction generally perpendicular to the first direction, thereby substantially preventing displacement of the workpiece.

2. The press molding die according to claim 1, wherein the particulate coating process is performed using a silicofluoric chrome plating solution.

3. The press molding die according to claim 2, wherein the silicofluoric chrome plating solution contains 200 to 300 g of chromic anhydride, 1 to 8 g of sodium silicofluoride, and 0.5 to 1.5 g of sulfuric acid per liter, and the particulate coating process is performed in a condition in which a temperature of the plating solution is 40 to 50° C., a current density is 100 to 150 A/dm$^2$, and a plating time is 3 to 10 minutes.

4. The press molding die according to claim 1, wherein a plurality of grooves which are parallel to each other, and another plurality of grooves which are parallel to each other are formed on the molding surface such that the plurality of grooves and the other plurality of grooves extend in different directions.

* * * * *